United States Patent [19]

Maloney, Jr. et al.

[11] 4,092,808

[45] June 6, 1978

[54] COMBINATION EAVES TROUGH AND FASCIA WITH SOFFIT CONNECTION MEANS, AND METHOD OF MAKING SAME

[75] Inventors: John E. Maloney, Jr., Addison; Richard F. Zaccagni, Lombard, both of Ill.

[73] Assignee: ZMC, Inc., Addison, Ill.

[21] Appl. No.: 592,388

[22] Filed: Jul. 2, 1975

Related U.S. Application Data

[63] Continuation-in-part of Ser. No. 506,359, Sep. 16, 1974, abandoned.

[51] Int. Cl.[2] ..... E04D 13/00

[52] U.S. Cl. ..... 52/11; 52/94; 29/DIG. 32

[58] Field of Search ..... 52/11, 94, 15, 16; 29/DIG. 32

[56] References Cited

U.S. PATENT DOCUMENTS

| | | | |
|---|---|---|---|
| 2,896,559 | 7/1959 | Stephens | 52/94 |
| 3,440,778 | 4/1969 | Miles et al. | 52/11 X |
| 3,864,882 | 2/1975 | Lasscock | 52/11 |
| 3,913,284 | 10/1975 | Hall | 52/11 |

FOREIGN PATENT DOCUMENTS

| | | | |
|---|---|---|---|
| D42,881 | 12/1961 | Australia. | |
| D46,957 | 12/1964 | Australia. | |
| 683,196 | 3/1964 | Canada | 52/11 |

*Primary Examiner*—Ernest R. Purser
*Assistant Examiner*—Carl D. Friedman
*Attorney, Agent, or Firm*—Hill, Gross, Simpson, Van Santen, Steadman, Chiara & Simpson

[57] ABSTRACT

The combination eaves trough and fascia with soffit connection means comprises a generally channel-shaped upwardly opening elongated sheet metal gutter member having an upright front wall providing a fascia surface, a bottom generally horizontal wall, and an upright back wall adapted to be mounted directly on the ends of rafter tails. The gutter member is of a vertical dimension to enable it to replace a conventional fascia. An integral horizontal reinforcing rib providing a socket groove is formed directly in the sheet metal material in the lower portion of the gutter member at the juncture between the bottom wall and one of the upstanding walls of the gutter member, and the groove opens toward the back of the gutter member to receive an edge of a soffit panel which has its opposite edge portion attached to an associated building.

Closing-in structure is provided for either or both ends of the gutter and soffit assembly.

15 Claims, 9 Drawing Figures

COMBINATION EAVES TROUGH AND FASCIA WITH SOFFIT CONNECTION MEANS, AND METHOD OF MAKING SAME

The present application is a continuation-in-part of our copending applications Ser. No. 506,359 filed Sept. 16, 1974, now abandoned.

This invention is concerned with building structures and more particularly relates to a combination eaves trough and fascia with soffit connection means, and method of making same.

As heretofore constructed eaves structure has generally been boxed in by fascia and soffit boards or panels, and eaves troughs have been hung from the roof in front of the fascia or have been secured to the fascia. In addition to the cost of the fascia board or panel, the labor cost of installing the fascia has been involved in addition to hanging the gutter.

Heretofore, it has been proposed to avoid this costly construction by providing a gutter member with a separately formed and attached channel to receive the edge of a soffit panel; (see Australia Pat. No. 227,207/59) but the production cost for such an assembled gutter and soffit channel is still too high to be practical, and it does not present as neat and trim an appearance as desirable.

According to the present invention it is a principal aim to overcome the disadvantages, deficiencies, inefficiencies, shortcomings and problems in prior constructions and to provide a new and improved and advantageous structure wherein an eaves trough formed from sheet metal comprises a generally channel-shaped upwardly opening elongated gutter member having front, bottom and back walls and adapted to be mounted directly on the ends of rafter rails, the vertical dimensions of the gutter member being such that the upper end of said back wall can lie adjacently under the roof drip line and the lower portion of the gutter member including the bottom wall will be located below the rafter tails whereby the gutter member can serve as a combination gutter and fascia. On the upper portion of the back wall are means for securing the gutter member to the rafter tail ends. An integral recessed and reinforcing rib is formed directly in the sheet metal material along the lower portion of the gutter member at the juncture between the bottom wall and one of the upstanding walls of the gutter member and defines a horizontal socket groove opening toward the back of the gutter member to receive an edge of a soffit panel which has its opposite edge portion attached to an associated building. When the soffit panel edge is inserted as a tongue into the socket groove no more than a single line may be noticed at juncture of the soffit panel with the gutter member and the soffit panel appears as substantially a continuation of the bottom of the gutter member.

At either or both ends of the gutter member and soffit panel assembly a neat closing-in structure finishes off any gap between the gutter member, the soffit panel and roof eaves sloping toward the gutter member.

Other objects, features and advantages of the invention will be readily apparent from the following description of a representative embodiment thereof, taken in conjunction with the accompanying drawings although variations and modifications may be effected without departing from the spirit and scope of the novel concepts embodied in the disclosure, and in which.

Figures 1, 2, 3:
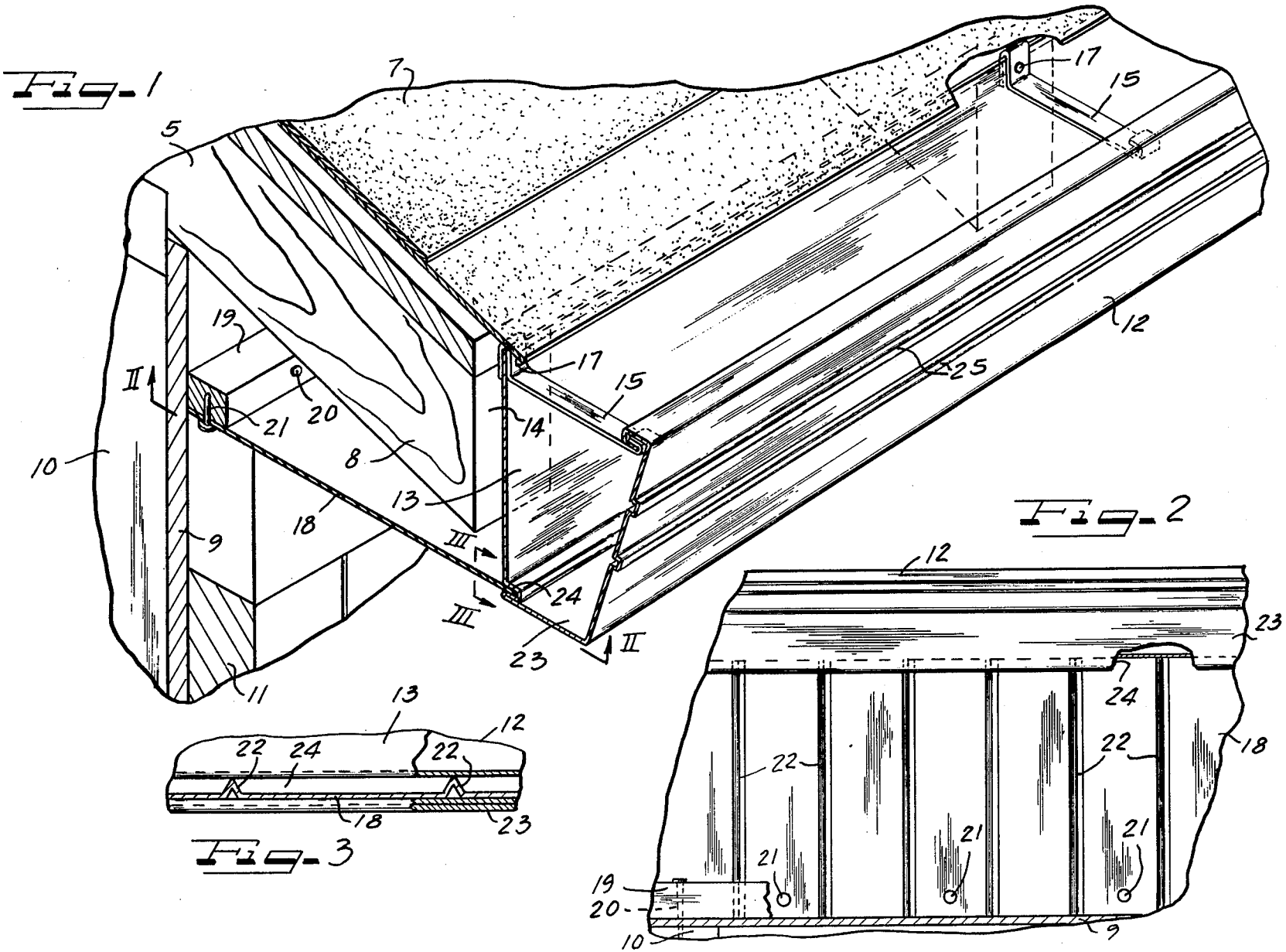
FIG. 1 is a fragmentary isometric view of the eaves structure of a building embodying features of the present invention.
FIG. 2 is a fragmentary plan view, partially broken away for illustration, taken substantially along the line II—II of FIG. 1.
FIG. 3 is a fragmentary sectional detail view taken substantially along the line III—III of FIG. 1.

On reference to FIG. 1, a representative roof eaves structure of a building is depicted in which rafters 5 carrying roofing 7 have rafter tails 8 in eaves projection from the associated vertical building wall which may have customary sheathing panel means 9 attached to studs 10 and provided with any preferred outside facing applied thereto, such as brick veneer 11, or other types of siding.

According to the present invention, an eaves trough member of generally channel-shaped upwardly opening elongated gutter form has an upright front wall 12 and an upright back wall 13 adapted to be mounted directly on vertical end faces 14 of the rafter tails 8. In order to replace and eliminate any need for a conventional fascia, the gutter member is dimensioned vertically to provide this function. For example, where the rafters 5 are standard 2 × 4's the height of the gutter member, at least at its back wall 13 may be about 6 to 6½ inches (15 to 16 cm). Thereby the gutter member can be installed with its back wall 13 directly mounted on the rafter tail faces 14, with the upper end of the back wall 13 closely under the roof drip line and providing means for attaching the gutter member to the rafter tails. The lower portion of the gutter member including the back wall 13 projects below the rafter tails. Securing means for the gutter member may comprise gutter brackets 15 spanning between the interhooked with the tops of the front wall 12 and the back wall 13, nailed together with the upper end portion of the back wall 13, by means of nails 17, to the upper portions of the rafter tail end faces 14. Through this arrangement, the gutter member completely replaces the conventional fascia, the front wall 12 serving this purpose.

In order to box in the underside of the eaves, a soffit in the form of a panel 18 is provided. To support the back margin of the soffit 18 on the building wall, a horizontal nailing strip 19 may be secured to the wall as by means of nails 20 at a suitable height so that the underside of the strip will support the back margin of the soffit 18 fastened to the strip as by means of nails 21, power tool driven staples, or the like. In a desirable form, the soffit panel 18 may be a built-up panel such a plywood, sheathed pressboard, or the like, but is preferably made from suitable gauge aluminum sheet material provided with reinforcing ribs 22 extending thereacross at suitable intervals normal to the axis of the gutter member 12 and running out at the front edge of the panel.

Contiguous to a bottom wall 23 which connects the front wall 12 and the back wall 13 of the gutter member and lies below the rafter tails in the hung position the gutter member, there is rall formed an integral horizontal reinforcing groove recessed rib defining a socket groove 24 which extends along the entire length of the gutter member directly in one piece with the sheet metal material of the lower portion of the gutter member and as part of the juncture of the bottom wall and one of the upstanding walls of the gutter member. The socket groove 24 opens toward the back of the gutter member to receive an edge of the soffit panel 18 which has its opposite edge portion attached to the associated building by fastening to the nailing strip 19.

In one arrangement (FIGS. 1 and 6), the upstanding gutter back wall 13 has the socket groove 24 recessed in a reinforcing rib in its lower portion and with a major extent of said wall extending upwardly from said rib. As will be observed, the reinforcing groove recessed rib is of generally return bent formation, and has the lower side of the groove defined by a folded groove wall flange **24*a* contiguous to the adjacent portion of the bottom wall 23 whereby the double thickness of material provides a firm base for support of the soffit panel. Furthermore, this structure provides desirable reinforcement along the inner margin of the bottom wall 23. Not only does the folded flange 24*a* provide such reinforcement in and of itself, but by virtue of the angular cross sectional shape of the groove profile, including an inner or spaced socket groove root wall 24*b* extending angularly relative to the bottom groove wall flange 24*a* and a top groove wall flange 24*c* extending angularly between the upper edge of the groove root wall 24*b* and the main panel of the back wall 13**, a reinforcing rib structural formation is provided by the groove profile extending all along the length of the gutter member and thereby not only stiffening and reinforcing the back wall but also the lower portion of the gutter member and materially assisting in maintaining the gutter member in general straight and thoroughly resistive to sagging even in long lengths.

Figure 6:
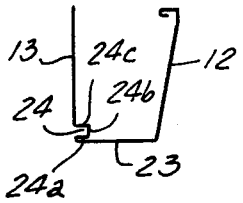
FIG. 6 is a schematic line drawing showing a preferred profile of the gutter member.

The construction of the gutter member as depicted in FIGS. 1 and 6 provides a most neat and attractive appearance in assembly with the soffit panel 18, affording the appearance of the soffit panel being substantially a continuation of the bottom wall 23 of the gutter member, or conversely, that the bottom wall 23 of the gutter member is a front marginal border of the soffit panel. To this end, the folded groove wall flange **24*a*** is of such thin return bent folded simple double thickness flat form that the thin edge integral connection joining the layers and facing toward the back of the gutter member so thoroughly blends with the surface of the soffit panel as to be almost imperceptible.

Figure 7:
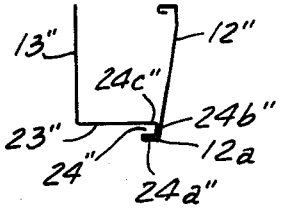
FIG. 7 is a similar schematic line drawing view showing another modified profile for the gutter member.

Should it be desired to provide an even more concealed relationship of the gutter member in respect to the eaves treatment, the construction of the gutter depicted in FIG. 7 may be employed wherein although the soffit receiving socket groove 24″ is in the lower portion of the gutter member, just as it is in the lower portion of the gutter member in the form of FIG. 6, the socket groove 24″ is contiguous to the bottom wall 23″ adjacent to the front wall 12″ instead of the back wall 13″, and opens toward the back of the gutter member under the bottom wall 23″. To this end, the profile of the socket groove 24″ is defined by a bottom wall flange **24*a*″ and a root panel 24*b*″ angularly related and internested in a complementary lower generally L-shaped extension 12*a* along the lower margin of the front wall 12′. In this instance the upper wall 24*c*″ defining the socket groove 24″ comprises the front margin of the bottom wall 23″. Through this arrangement, the bottom wall 23″ will be in overlying relation to the soffit panel assembled with the gutter member and having its front edge received in the socket groove 24″. Thereby, the front wall 12″ will appear as merely a fascia assembled with the front edge of the soffit panel, with the underturned flange formation 12*a* appearing as a finishing bead along the front edge of the soffit panel. In this instance, similarly as in respect to the form of FIG. 6, the profile of the socket groove 24″ provides a reinforcing rib structure for the lower portion of the gutter member, and in this instance further reinforced and stiffened by the underturned angular cross section front wall extendsion 12*a***.

Figure 8:
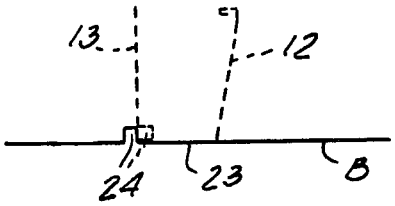
FIG. 8 is a schematic illustration showing how the gutter profile of FIG. 6 is adapted to be attained by rolling in sheet metal.

Any of the forms of the gutter member equipped with the soffit receiving socket groove, whether in the form of FIG. 6, or FIG. 7, can be economically formed by sheet metal rolling for highspeed mass production. Thus, as represented in FIG. 8, a sheet metal blank B preferably comprising aluminum with a preferred prefinish such as an acrylic surface coating and supplied in strip form is formed up into any desired gutter lengths by running the material through suitable progressive forming rolls as is customary in the formation of aluminum rain gutters, except that the soffit panel receiving socket groove is formed at a preferred stage in the roll forming process. In a preferred forming sequence, the socket groove 24, is shaped in the portion of the blank which will provide the back wall 13, and the back wall panel portion then bent up into its final position relative to the bottom wall portion 23 of the blank concurrently with bending up of the front wall panel 12, the groove formation being moved into position together with the back wall panel 13.

Figure 9:
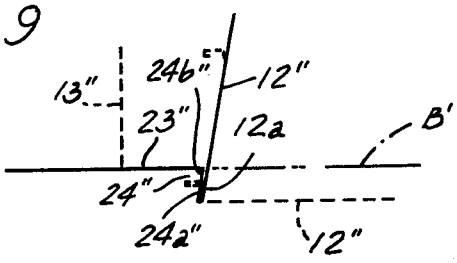
FIG. 9 is a schematic illustration showing steps in rolling sheet metal to attain the gutter profile of FIG. 7.

Similarly, the form of FIG. 7 is adapted to be efficiently roll formed as exemplified in FIG. 9. As a first step, the profile for the socket groove 24″ is partially formed by bending the panel sections **24*a*″ and 24*b*″ angularly downwardly in a common plane relative to the portion of the blank B′ to form the bottom wall 23″. Then, the panel portion to form the front wall 12″ is bent up along juncture with the groove section 24*a*″, as shown in full outline in FIG. 9 and wherein the extension portion 12*a* is moved into position relative to the groove panel sections 24*a*″ and 24*b*″. Concurrently or subsequently the back wall panel 13″ is bent up relative to the bottom wall 23″. After the front wall portion 12″ has been bent up, the double thickness downwardly extending extension 12*a* and the socket panel portion 24*a*″ are bent into generally parallel relation to the bottom wall 23″ to complete the socket groove 24″. At a suitable point in the gutter formation, the upper margin of the panel providing the front wall 12″** is formed to the desired shape.

The socket grooves 24, and 24″ are dimensioned to receive the outer edge portion of the soffit panel 18 with a sliding fit. In a practical construction where the overall thickness of the soffit panel 18 inclusive of the ribs 22 is about ½ inch (about 13mm) the vertical width of the socket groove may be about the same dimension, and horizontal depth of the socket groove may be about ¾ inch (about 19mm). This provides adequate firm support for the soffit panel 18 not only at its back margin, but also at its front margin which is thrust tongue and groove fashion into the socket groove. If desired, a mastic material such as caulking compound, rubber gutter cement, or the like may be applied within the socket groove to seal the joint between the gutter and the soffit panel.

As is customary, the soffit panel 18 is disposed in a generally horizontal plane. At its back, nailed margin, the soffit panel 18 overlies the wall facing, such as the veneer bricks 11 (FIG. 1) or siding (FIG. 4) in the completed wall. Any preferred exterior finish may be provided on the gutter member 12 and the soffit panel 18, such, for example, as the customary baked on white or colored enamel finish supplied for exterior aluminum paneling and other members.

As installed, and fully boxing in the eaves, the gutter member 12 and the soffit panel 18 blend together so harmoniously by reason of the tongue and groove interlock within the groove 24, 24" that viewed from the ground the assembly has a pleasing unitary appearance, wherein the joint between the gutter member and the soffit panel may be hardly noticeable. Adding to the pleasing appearance, and providing reinforcement for the front generally upright wall of the gutter member 12 may be one or more, and in this instance two, longitudinally extending ornamental and reinforcing ribs 25.

Figure 4:
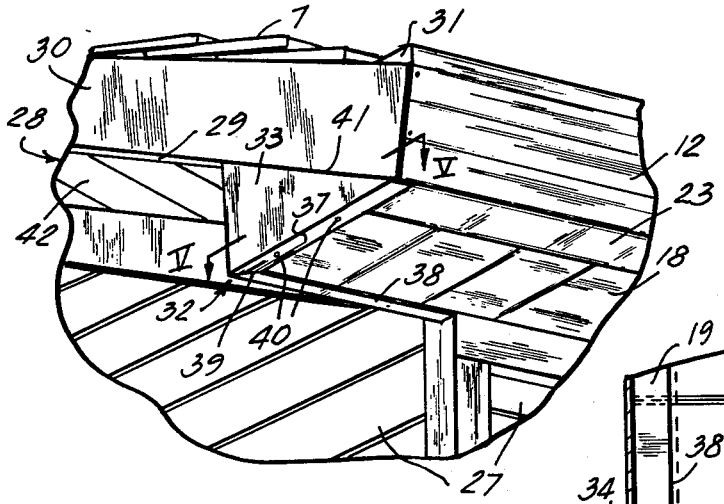
FIG. 4 is a fragmentary perspective view looking upwardly toward a gutter and soffit assembly according to the present invention and showing closing-in structure to finish off and conceal the gap between the soffit, the gutter member and the associated sloping roof eaves.
Figure 5:
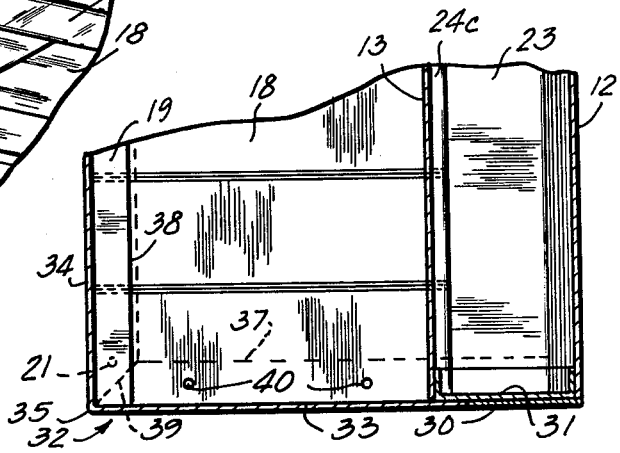
FIG. 5 is a fragmentary sectional plan view taken substantially along the line V—V of FIG. 4.

A new and improved closing-in treatment at one or both opposite ends of the installed combination eaves trough and fascia and soffit assembly is represented in FIGS. 4 and 5 wherein the eaves structure at one corner of a building such as a dwelling is shown, in this instance provided with clapboard type siding 27 which may be wood or aluminum, instead of the brick siding shown in FIG. 1. Regardless of the type of siding, the eaves treatment, employing the present invention will be substantially the same. Both the gutter member and the assembled soffit panel 18 project beyond the corner of the building to the extent of the sloping roof line eaves overhang at the side of the building and represented at 28 and having the usual bargeboard 29 which may be covered at its outer side with a facing panel 30 made from aluminum sheet having a suitable finish and extending into lapping relation over the adjacent end of the gutter member closed by a complementary end closure 31. Support for the back edge of that portion of the soffit panel 18 which projects under the sloping eaves 28 is provided by extension of the nailing strip 19 to which the back margin of the soffit panel 18 is fastened by means of the nails.

Closing-in of the opening back of the gutter, under the bargeboard 29 and above the underlying portion of the soffit panel 18 is effected simply, efficient and neatly by means of a formed sheet metal member 32 which is desirably made from similar material as the soffit panel 18, e.g. prefinished aluminum sheet, with the finish matching the gutter and the soffit panel, and preferably also the facing sheet 30. For this purpose, the member 32 has a vertical end closure wall 33 joined to a back closure wall 34 integrally at a juncture bend 35, which is preferably a right angular bend. At their lower margins, the walls 33 and 34 have respective underturned reinforcing and finishing flanges 37 and 38 which are joined at a miter joint 39. The flange 37 underlies the end margin of the soffit panel 18 and may be fastened thereto as by means of pop rivets 40. In addition, the flange 37 desirably underlies the adjacent end of the gutter member. At the back of the assembly, the flange 38 underlies the back margin of the soffit panel 18 and may be suitably secured thereto or the back panel 34 may be fastened to the nailing strip 19. In order to match the convergence of the lower edge of the finish sheet or panel 30 with the bottom of the gutter, the closing-in member wall panel 33 is of generally triangular outline having an upper edge 41 which obliquely matches and joins the lower edge of the panel 30 in a neat joint. The back panel 34 extends from the corner joint 35 to the adjacent corner of the building and has its upper edge complementary to and in engagement with the underside of the overhanging eaves 28 which may be provided with a soffit 42 against which the upper edge of the panel 34 engages to finish the closing-in structure. It will be apparent that the closing-in member 32 provides a neatly finished appearance for the end of the gutter and soffit assembly. It will be appreciated, of course, that at the opposite end of the gutter and soffit assembly the closing-in member 32 may be a mirror image of the closing-in member 32 which has been illustrated in FIGS. 4 and 5.

It will be understood that variations and modifications may be effected without departing from the spirit and scope of the novel concepts of this invention.

We claim as our invention:

1. A combination eaves trough and fascia with soffit connection means, comprising:

an elongated, generally channel-shaped, upwardly opening gutter member roll-formed from one continuous strip of sheet metal and having a flat horizontal bottom wall and spaced apart upstanding front and back walls and adapted to be mounted directly on the ends of rafter tails of an overhanging eaves structure of a building roof;

said front and back walls having respective free upper portions and being integrally joined at their bottom portions to said bottom wall;

the vertical dimensions of said front and back walls and thereby the vertical dimensions of the gutter member being such that the upper portion of said back wall can lie adjacently under the roof drip line and the lower portion of the gutter member including the bottom wall will be located below the rafter tails whereby the gutter member will serve as combination gutter and fascia;

the upper portion of said back wall providing means for securing the gutter member to the rafter tail ends; and an integral groove recessed reinforcing rib roll-formed directly in and integrally in one piece with the sheet metal material of the gutter member horizontally in and along the lower portion of the gutter member at the juncture between the bottom wall and one of said upstanding walls;

the groove recessed rib defining a horizontal socket groove opening toward the back of the gutter member to receive an edge of a soffit panel;

said groove recessed rib being of a reentrant socket groove formation and having a pair of vertically spaced horizontal socket groove wall flanges and a vertical spacer socket groove root wall coextensive with said horizontal flanges and defining the socket width of said groove, and stiffening junctures joining said horizontal socket groove wall flanges to said vertical spacer socket groove root wall flange and to said one upstanding wall of the gutter member, said junctures cooperating with said wall flanges in attaining reinforcing stiffness in said groove recessed rib and thereby in the lower portion of said one upstanding wall and the gutter member in general;

the lowermost of said horizontal socket groove wall flanges comprising a return bent folded face-to-face double thickness of material wherein one thickness of the fold is integral with the lower edge of said one upstanding wall and the other thickness is integral with said bottom wall;

said thicknesses of material being joined together along a simple return bend providing a thin edge integral connection facing toward the back of the gutter member;

whereby when the edge of a soffit panel is received in said groove the appearance will be afforded of the soffit panel being substantially a continuation of the bottom wall of the gutter member.

2. An eaves trough according to claim 1, wherein the vertical dimension of said socket groove is about ½ inch (13mm), and the horizontal depth of the socket groove is about ¾ inch (19mm).

3. An eaves trough according to claim 1, wherein said said lowermost groove wall flange lier along the bottom wall of the gutter member.

4. An eaves trough according to claim 1, wherein said groove recessed rib is formed along the underside of said bottom wall and the socket groove opens toward the back of the gutter member under said bottom wall.

5. An eaves trough according to claim 4, wherein said rib is formed in a downward extension of said front wall lower portion.

6. An eaves trough according to claim 1, having in combination therewith a building eaves structure including rafter tails with end faces, means securing the back wall of the gutter member directly to said end faces with the upper edge of the back wall closely adjacent to the drip line of a roof over said eaves structure, the lower portion of said back wall of the gutter member extending below said end faces, a horizontal soffit panel having a back margin, means securing said back margin of the soffit panel fixedly under the eaves structure, and said soffit panel having a front margin slidably received as a tongue in said socket groove and appearing as substantially a continuation of said bottom wall of the gutter member.

7. A combination according to claim 6, wherein said soffit panel has reinforcing ribs extending out through said front margin, and said ribs engaging in sliding fit relation in the socket groove.

8. A combination according to claim 6, including a closing-in member assembled with adjacent ends of said gutter member and said soffit panel and having angularly related closing-in walls of substantial length extending respectively between an end of the soffit panel and the eaves structure and between a back marginal portion of the soffit panel and the eaves structure.

9. A combination according to claim 8, wherein said closing-in member comprises a one-sheet metal structure having underturned flanges along said walls contiguously underlying the soffit panel end and said back marginal portion respectively.

10. A combination according to claim 9, wherein said closing member wall along the end of the soffit panel also engages along the adjacent end of the gutter member and the underlying flange of such wall portion engaged under the end of the gutter member.

11. A combination according to claim 8, wherein said building eaves structure includes a bargeboard having a facing thereon, said closing-in member having an upper edge joining a lower edge of said facing.

12. A method of making a combination eaves trough and fascia with soffit connection means, comprising:

roll-forming a continuous strip of sheet metal into an elongated, generally channel-shaped, upwardly opening gutter member having a bottom wall and spaced apart upstanding front and back walls integrally joined at their bottom portions to said bottom wall and having free upper portions;

dimensioning the gutter member to be mounted directly on the ends of rafter tails of an overhanging eaves structure of a building roof, so that the upper portion of said back wall can lie adjacently under the roof drip line and provides means for attaching the gutter member to the rafter tails whereby the gutter member will serve as combination gutter and fascia;

roll-forming an integral groove-recessed rib directly in the sheet metal of the gutter member at the juncture between the bottom wall and one of the upstanding walls;

roll-forming in the groove-recessed rib a socket groove opening toward the back of the gutter member to receive an edge of a soffit panel;

said roll-forming of said rib comprising bending material integral with the lower portion of one of the upstanding walls of the gutter member and said bottom wall into a pair of coextensive vertically spaced horizontal socket groove wall flanges and a vertical spacer socket groove wall flange coextensive with said horizontal flanges to define the socket width of said groove, and forming angular reinforcing junctures along and joining said groove wall flanges to said root wall flanges and said one upstanding wall of the gutter member;

forming the lowermost of said horizontal socket groove wall flanges by return bend folding into face-to-face double thickness material in part on said one upstanding wall and in part on said bottom wall;

and forming at the juncture of the return bent folded thicknesses of material of said lowermost socket groove wall flange a simple return bent thin edge integral connection facing toward the back of the gutter member so that when a soffit panel is received edgewise in the groove of the gutter member the appearance will be as though the panel is substantially a continuation of the bottom wall of the gutter member.

13. A method according to claim 12, comprising forming said along said bottom wall of the gutter member.

14. A method according to claim 12, comprising forming said groove recessed rib along the underside of said bottom wall with the socket groove opening toward the back of the gutter member under said bottom wall.

15. A method according to claim 14, comprising forming a downward extension of the lower portion of said front wall and folding the groove recessed rib from said downward extension.

* * * * *